United States Patent [19]

Sekiya et al.

[11] 4,445,300

[45] May 1, 1984

[54] METHOD FOR GRINDING FLAT PLATES

[75] Inventors: Shinji Sekiya, Tokyo; Takatoshi Ono, Nagareyama, both of Japan

[73] Assignee: Disco Co., Ltd., Tokyo, Japan

[21] Appl. No.: 212,669

[22] Filed: Dec. 3, 1980

[30] Foreign Application Priority Data

Feb. 1, 1980 [JP] Japan ..... 55-10887

[51] Int. Cl.[3] ..... B24B 7/20

[52] U.S. Cl. ..... 51/283 R; 51/326

[58] Field of Search ..... 51/281 R, 281 SF, 283 R, 51/283 E, 206 R, 356, 209 DL, 209 S, 206 P, 209 R; 125/3

[56] References Cited

U.S. PATENT DOCUMENTS

| | | | |
|---|---|---|---|
| 875,935 | 1/1908 | Landis | 51/206 R |
| 1,954,330 | 4/1934 | Schurr | 51/209 R |
| 2,811,960 | 11/1957 | Fessel | 51/206 R |
| 2,867,063 | 1/1959 | Metzger | 51/209 R |
| 2,980,098 | 4/1961 | Wayland | 125/3 |
| 3,161,995 | 12/1964 | Linblad | 51/209 R |
| 3,290,834 | 12/1966 | Linblad | 51/206 R |
| 3,664,068 | 5/1972 | Metzger et al. | 125/3 |
| 3,691,707 | 9/1972 | Von Arx et al. | 51/281 R |

FOREIGN PATENT DOCUMENTS

| | | | |
|---|---|---|---|
| 147605 | 6/1936 | Austria | 51/206 R |
| 890911 | 5/1953 | Fed. Rep. of Germany | 51/209 R |
| 2332105 | 6/1977 | France | 51/209 R |
| 1215064 | 12/1970 | United Kingdom . | |
| 1449430 | 9/1976 | United Kingdom . | |

*Primary Examiner*—Frederick R. Schmidt
*Assistant Examiner*—Robert A. Rose
*Attorney, Agent, or Firm*—Flynn, Thiel, Boutell & Tanis

[57] ABSTRACT

Grinding of flat plates is performed by using a very thin, conical grinding wheel which is attached to the open end of a revolving cup and which projects outwardly from and is inclined with respect to the cup. The peripheral cutting edge of the grinding wheel revolving at high speed is brought into contact with the work. As the grinding wheel is fed, the work is cut by the grinding wheel across its thickness and an undercut part of the work disrupts (i.e. breaks off) by itself to a desired thickness. Thick grinding is also possible if a multiplicity of the grinding wheels are placed one over another at proper intervals.

2 Claims, 7 Drawing Figures

METHOD FOR GRINDING FLAT PLATES

BACKGROUND OF THE INVENTION

The present invention relates to a method for grinding a flat plate by the cutting action of a grinding wheel across the thickness of the plate.

Heretofore, grinding of flat surfaces of a hard, brittle work (1), like silicon and glass, has been accomplished by the use of a ring-shaped grinding wheel (2) attached to the lower open end of an inverted revolving cup (10) as shown in FIG. 1 (*a*). This conventional method has a drawback that grinding has to be repeated until the work is ground to a desired thickness. In other words, the conventional grinding wheel (2) having its side and bottom extending at right angles to each other grinds the work with both its side and bottom. In such a grinding mode, there is a great contact area that generates a large amount of friction heat, thereby impairing the dimensional accuracy of the work due to thermal expansion, and loading of the pores of the grinding wheel with chips is likely to occur, resulting in dulling, burn marks, and grinding cracks. In addition, the cutting edge of the grinding wheel (2) becomes dull during grinding, causing the grindstone to lose proper contact with the work. This makes it difficult to grind the work with one pass, and makes it necessary to repeat the grinding bit by bit in order to grind the work to a desired thickness. In another type of conventional grinding wheel, the bottom is tapered inwardly as shown in FIG. 1 (*b*). This grinding wheel still has a large contact area and easily loses its sharpness, thereby making it necessary to regenerate the taper.

BRIEF SUMMARY OF THE INVENTION

It is an object of this invention to provide a method for grinding hard, brittle flat plates easily and accurately to a desired thickness, by the use of a thin grinding wheel which extends at a certain angle with respect to the surface to be ground. That part of the work to be removed by grinding is undercut by the grinding wheel and the undercut part disrupts, or breaks off, by itself into coarse chips. Thus, only the surface is ground by the grinding wheel. Unlike conventional methods, the grinding method according to this invention gives off coarse chips and a small quantity of fine powder. Grinding according to the method of this invention generates very little friction heat, minimizing burn marks, grinding cracks, and loss of dimensional accuracy due to thermal expansion.

The other objects and advantages of this invention will be apparent from the description that follows.

BRIEF DESCRIPTION OF THE INVENTION

FIGS. 1(*a*) and 1(*b*) are sectional views showing conventional grinding methods.

DETAILED DESCRIPTION OF THE INVENTION

Figure 1A:
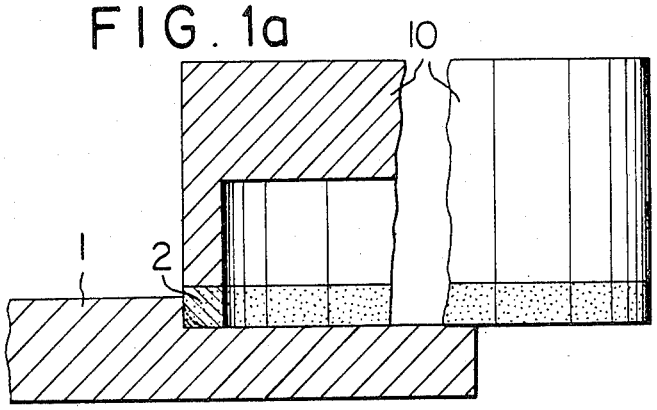
PRIOR ART FIG. 1a
Figure 1B:
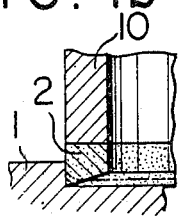
PRIOR ART FIG. 1b

The invention will be described into detail referring to the embodiments illustrated in the drawings.

Figure 2:
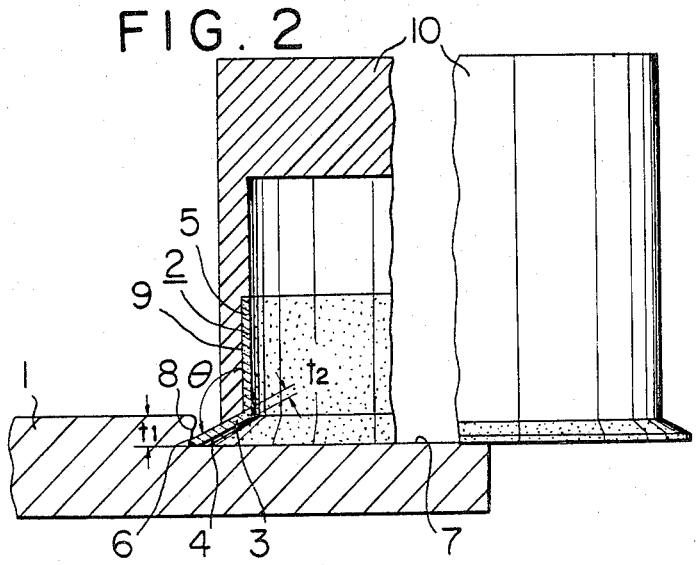
FIG. 2 is a sectional view showing an embodiment of the grinding method according to this invention.

In FIG. 2 showing grinding according to the method of this invention, the work (1) is hard, brittle silicon, glass, and the like which is easy to break with only a slight pressure. The thin grinding wheel (2) to grind the work (1) is formed by electrodeposition of super hard abrasive grains (super hard crystalline materials such as diamond grains and cubic system boron nitride). The grinding wheel is a cylinder with its lower end, or skirt, expanded outward aslant. The edge portion of the expanded part is the grinding part (3), which is 0.1 to 0.5 mm thick and about 5 mm wide. The bottom (4) of such edge portion is inclined 10° to 45° with respect to the grinding surface (7), or the angle ($\theta$) held between the fitting part (5) and the grinding part (3) is 100° to 135°, so that the bottom (4) does not come into contact with the grinding surface (7) of the work (1). Thus, the cutting edge (6) comes to contact with the cutting face (8) of the work (1) with a minimum of area. The said vertical fitting part (5) is firmly fixed, by bonding and the like, to the stepped part (9) inside the inverted cup (10).

The grinding stone (2) thus constructed accomplishes grinding based on the principle of cutting. The grinding wheel (2) is rotated at high speed together with the cup (10), and the grinding wheel (2) is advanced or the work (1) is moved. The relative position of the grinding wheel (2) and the work (1) is so adjusted that the grinding thickness ($t_1$) is 0.3 to 0.8 mm, several times the thickness ($t_2$) of the grinding wheel (2). Grinding is started with the edge (6) in contact with the side of the work (1), and then the grinding wheel (2) or the work (2) is moved at a predetermined speed. It should be noted that grinding is accomplished in such a manner that only the edge (6) of the grinding wheel (2) is in contact with the cutting face (8) and the undercut portion of the work (1) above the grinding part (3) disrupts by itself due to its brittleness. In other words, the portion of the work above the cutting face (8) is not actually ground, but disrupts by itself, and the grinding surface (7) is ground neatly by the grinding wheel (2). Thus, coarse chips and a small quantity of fine powder are given off as the result of grinding.

Figure 3:
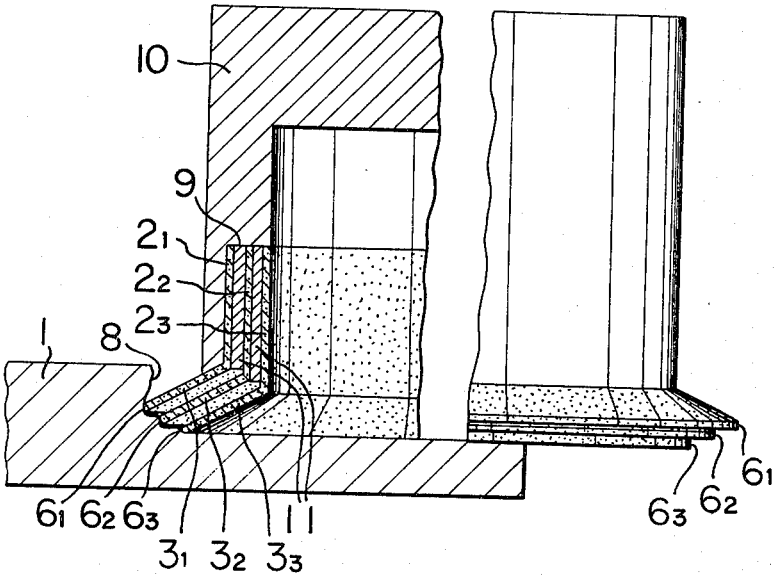
FIG. 3 is a sectional view showing another embodiment of the grinding method according to this invention.

FIG. 3 shows another embodiment to grind the work (1) to a greater depth with a single pass. In this embodiment, three grinding wheels ($2_1$), ($2_2$), and ($2_3$) having slightly different diameters are attached to the stepped part (9) inside the cup (10). The fitting part (5) of the grinding wheel ($2_1$) of the largest diameter is fastened to the stepped part (9) inside the cup (10). The grinding wheel ($2_2$) of middle diameter is fastened through the spacer (11) to the inside of the fitting part (5). Finally, the grinding wheel ($2_3$) of the smallest diameter is fastened through the spacer (11) in the same manner. Thus the grinding part (3) is arranged in three layers and the cutting edges ($6_1$), ($6_2$), and ($6_3$) having different diameters are arranged at certain intervals.

With the construction mentioned as above, grinding of the work (1) to a greater depth can be accomplished with a single pass because those portions which are undercut by the cutting edges ($6_1$), ($6_2$), and ($6_3$) of the respective grinding wheel ($2_1$), ($2_2$), and ($2_3$) disrupt by themselves as mentioned above.

Figure 4:
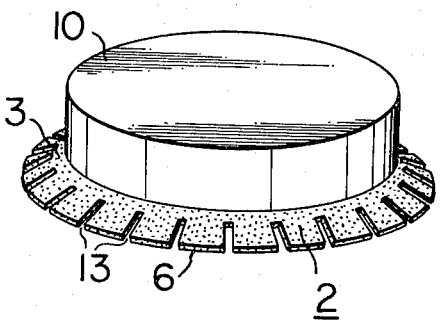
FIG. 4 is a perspective view of a slotted grinding wheel for another embodiment.
Figure 5:
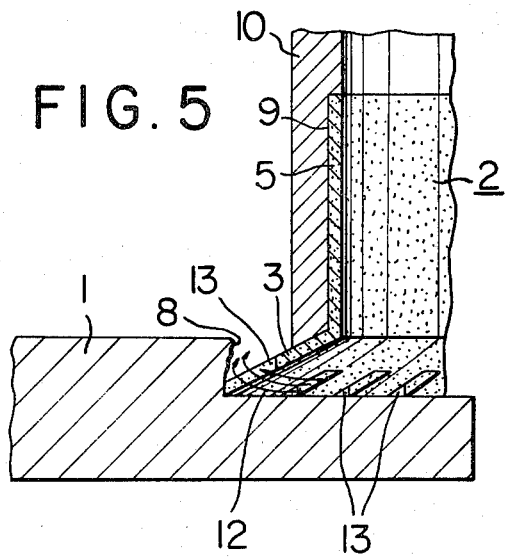
FIG. 5 is a sectional view of the embodiment of FIG. 4 showing the manner in which the slotted grinding wheel is cooled with water.

In another embodiment as shown in FIG. 4, the grinding wheel (2) is provided with slots (13) through which injected cooling water (12) and chips pass. The slots (13) extend from the cutting edge (6) to the middle of the grinding part (3). The use of the slotted grinding wheel prevents pores from loading with chips, keeping the sharpness. In addition, the cooling water (12) injected from the inside of the grindstone (2) reaches the cutting face (8) through the slot (13) to remove chips and cool the work (1) and the grinding wheel (2). The thinner and the more the slots (13), the more effective; but the depth, width, and number of the slots should be determined according to the object so that necessary strength is retained.

Figure 6:
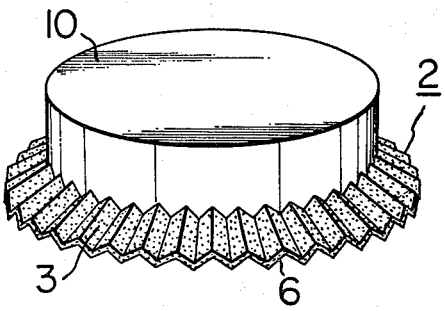
FIG. 6 is a perspective view of a grinding wheel for another embodiment of this invention.

FIG. 6 shows another embodiment of grinding wheel according to the invention which is free from loading and has high strength. The grinding part (3) of the grinding wheel (2) has a wavy form as viewed from side. The more and finer the wave forms, the more desirable. The wave may be either sharp triangular or sinusoidal curve. Also, for the same object, small holes 0.1 to 0.2 mmϕ may be formed by electrospark machining on the grinding part (3).

What is claimed is:

1. In an improved method for grinding flat plates by rotating at high speed a grinding wheel attached to the open end of an inverted cup, comprising providing a thin grinding wheel of super hard crystalline material comprising a thin circumferential skirt of uniform thickness projecting outward aslant from the open end of the cup at an angle in the range of about 10 to 45 degrees to the work surface being ground, bringing the peripheral edge of said thin skirt into contact with the work, undercutting the work with the skirt peripheral edge in a direction transverse to the thickness of the work, and causing the undercut portion of the work to disrupt by itself, wherein the improvement comprises providing the open end of the inverted cup with a multiplicity of said thin skirts with the edge thicknesses of the skirt being held constant in the range of about 0.1 mm to 0.5 mm thickness, and including spacing the respective thin skirts of said wheel one above another along the cup axis in partly overlapping relation so that a given skirt is supported radially outward of the cup from beneath by the skirt directly beneath it, said undercutting of the work occurs above the upper one of the skirts, and only the thin peripheral edge of each skirt is brought into contact with the work.

2. A method for grinding flat plates as claimed in claim 1, in which said crystalline material is selected from the group consisting of diamond grains and cubic lattice system boron nitride.

* * * * *